US007878382B2

(12) United States Patent
Kirst et al.

(10) Patent No.: US 7,878,382 B2
(45) Date of Patent: Feb. 1, 2011

(54) WIRE FEED DRIVE ASSEMBLY

(75) Inventors: Michael A. Kirst, Pewaukee, WI (US); Harold J. Keene, Waukesha, WI (US)

(73) Assignee: Artos Engineering Company, Brookfield, WI (US)

( * ) Notice: Subject to any disclaimer, the term of this patent is extended or adjusted under 35 U.S.C. 154(b) by 0 days.

(21) Appl. No.: 12/468,177

(22) Filed: May 19, 2009

(65) Prior Publication Data

US 2010/0294823 A1 Nov. 25, 2010

(51) Int. Cl.
*B65H 20/00* (2006.01)

(52) U.S. Cl. ..... 226/186; 226/176; 226/177

(58) Field of Classification Search ..... 226/174, 226/176, 177, 181, 182, 185, 186, 187; 271/273, 271/274

See application file for complete search history.

(56) References Cited

U.S. PATENT DOCUMENTS 3,844,179 A * 10/1974 Hawley ..... 74/409
3,854,672 A * 12/1974 Tilban ..... 226/195
4,493,233 A 1/1985 Dusel et al.
4,502,586 A 3/1985 Dusel et al.
5,007,272 A * 4/1991 Matsunaga et al. ..... 72/226
5,060,395 A 10/1991 Pepin
5,317,812 A 6/1994 McMillin et al.
5,398,573 A 3/1995 Wollermann
5,913,469 A * 6/1999 Suzuki ..... 226/36
5,934,161 A 8/1999 Keene
5,979,272 A 11/1999 Wollermann
6,041,991 A 3/2000 Mehri et al.
6,425,473 B1 7/2002 Meisser et al.
7,090,215 B2 * 8/2006 Mandel et al. ..... 271/273
7,363,693 B2 4/2008 Fischer
7,364,059 B2 * 4/2008 Huismann et al. ..... 226/111
7,398,903 B2 7/2008 Ulrich
2004/0251607 A1 * 12/2004 Mandel et al. ..... 271/220

* cited by examiner

*Primary Examiner*—Evan H Langdon
(74) *Attorney, Agent, or Firm*—Andrus, Sceales, Starke & Sawall, LLP

(57) ABSTRACT

A wire feed station of a wire processing system draws a supply of wire into the system. The wire feed station includes first and second feed wheels that create a nip to pull the wire through the feed station. A drive assembly is coupled to the first and second feed wheels to cause rotation of the feed wheels. The drive assembly includes first and second drive shafts that are coupled to the first and second feed wheels through a pair of flexible couplings. The flexible couplings allow the first and second feed wheels to move relative to each other to adjust the feed nip. The flexible couplings allow a single drive motor to rotate the first and second feed wheels through a pair of drive shafts without the use of a complex belt or gear assembly.

11 Claims, 6 Drawing Sheets

WIRE FEED DRIVE ASSEMBLY

BACKGROUND OF THE INVENTION

The present disclosure generally relates to a drive assembly for a wire feed station. More specifically, the present disclosure relates to a drive assembly that includes a single drive motor coupled to first and second feed wheels of the wire feed station through a pair of drive shafts and multiple flexible couplings.

A wire feed station of a wire processing system draws a supply of wire from a spool, barrel or wire pre-feeder for processing within the system. Typically, the wire feed station includes opposing wheels or belts that are forced against each other to create a feed nip to pull the wire from a supply source. In one configuration, the opposing feed wheels or belts are driven by independent drive motors. Each drive motor is coupled to one of the feed wheels to create the rotation of the feed wheels. Such system thus includes two relatively expensive drive motors.

In other available wire feed stations, the drive assembly includes a single drive motor that is coupled to wheels or belts through a serpentine belt arrangement or a gear arrangement. The serpentine belt or gear arrangement allows the feed wheels to move relative to each other. The serpentine belt or gear arrangement increases the cost and complexity of the drive assembly.

Although currently available wire feed stations function accurately to draw a supply of wire into the wire processing system, the wire feed stations are typically complex and require a relatively large amount of equipment. It is desirable to reduce the complexity of the wire feed station while allowing the wire feed station to accurately and reliably draw wire into the wire processing system.

SUMMARY OF THE INVENTION

The present disclosure relates to a drive assembly for use with a wire feed station that includes a first feed wheel and a second feed wheel that create an feed nip to pull the wire through the feed station. Both the first feed wheel and the second feed wheel are driven to pull wire through the feed nip.

The drive assembly includes a single drive motor that includes a rotating motor shaft. The drive motor can be any type of commercially available motor that rotates a motor shaft.

The drive motor includes a first drive gear that rotates along with the motor shaft. The first drive gear is positioned to engage a second drive gear through mating teeth formed on the drive gears. In this manner, both the first drive gear and the second drive gear are positively driven by the single drive motor.

The drive assembly further includes a first drive shaft that extends between the motor shaft and a wheel shaft of the first feed wheel. In accordance with one embodiment of the present disclosure, a flexible coupling is positioned between a first end of the first drive shaft and the motor shaft. A second flexible coupling is positioned between a second end of the first drive shaft and the wheel shaft of the first feed wheel. In this manner, the first drive shaft is able to translate rotational movement of the motor shaft to the wheel shaft of the first feed wheel.

The drive assembly includes a second drive shaft having a flexible coupling positioned between the first end of the second drive shaft and a driven shaft to which the second drive gear is mounted. Another flexible coupling is positioned between the second end of the second drive shaft and the wheel shaft of the second feed wheel. The use of multiple flexible couplings associated with each of the first and second drive shafts allow the first and second drive shafts to extend at an angle relative to the vertical drive axis that extends through the motor shaft. Likewise, the flexible couplings allow the first drive shaft and the second drive shaft to extend at an angle relative to the wheel shafts associated with the first feed wheel and the second feed wheel. The wheel shafts each extend parallel to the drive axis of the motor shaft.

The first feed wheel and the second feed wheel are each supported on separate mounting blocks. The mounting blocks are movable relative to each other to increase or decrease the size of the feed nip. The wheel shafts of each of the first and second feed wheels extend through the respective mounting block such that the distance between the wheel shafts can increase or decrease depending upon the size of the feed nip. During movement of the mounting block, the wheel shafts remain parallel to each other. The use of the flexible couplings between the first and second drive shafts and the wheel shafts of the first feed wheel and the second feed wheel compensate for the changing distance between the wheel shafts due to the movement of the mounting blocks.

The drive assembly of the present disclosure thus utilizes a single drive motor and a flexible linkage arrangement to rotate the first and second feed wheels of the wire feed station. The flexible linkage arrangement accommodates the movement of the mounting blocks relative to the stationary motor shaft and driven shaft associated with the first and second drive gears.

Various other features, objects and advantages of the invention will be made apparent from the following description taken together with the drawings.

BRIEF DESCRIPTION OF THE DRAWINGS

The drawings illustrate the best mode presently contemplated of carrying out the invention. In the drawings.

DETAILED DESCRIPTION OF THE INVENTION

Figure 1:
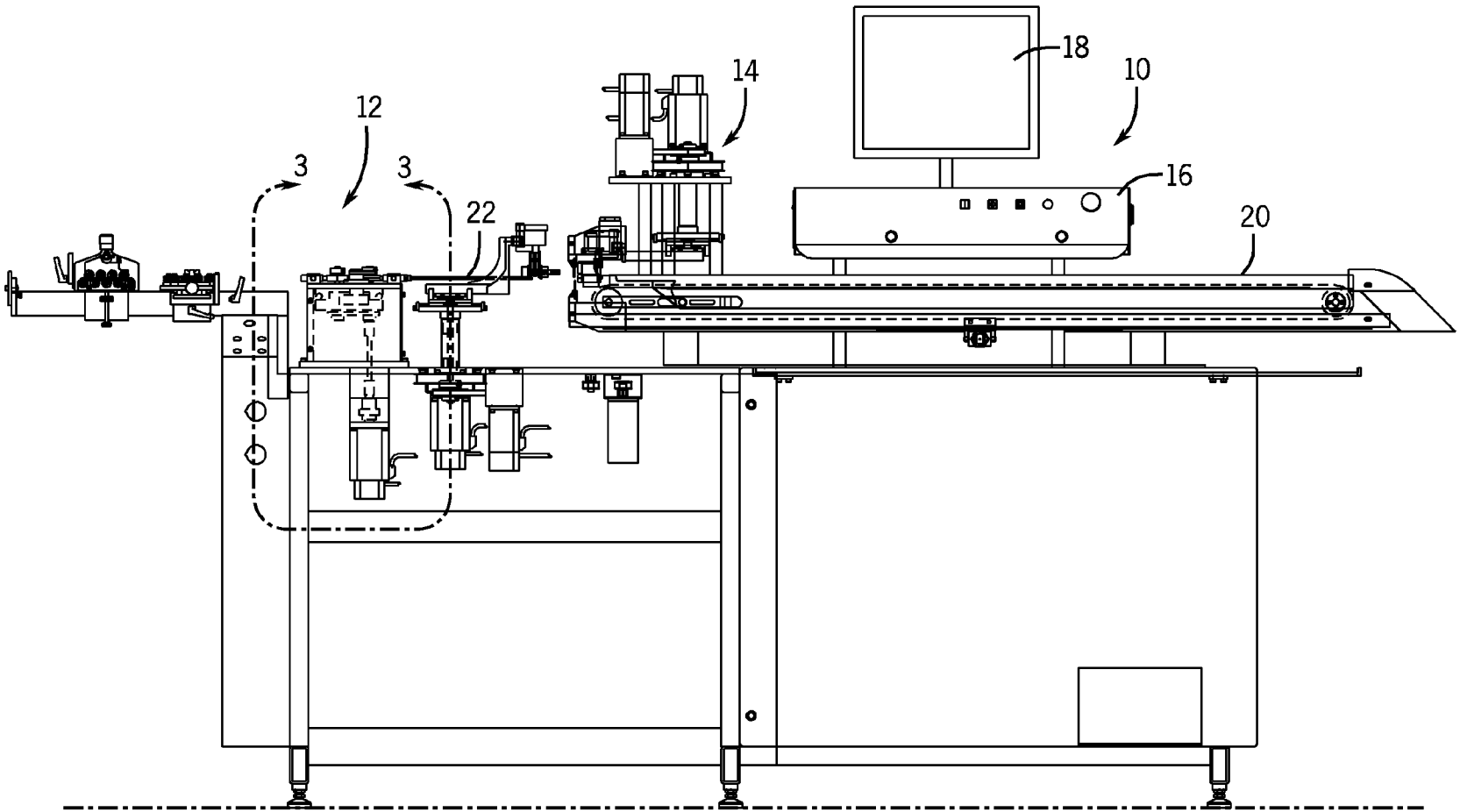
FIG. 1 is a side view of a wire processing system including the drive assembly of the present disclosure.

FIG. 1 illustrates a wire processing system 10 that is operable to receive a supply of wire and process the wire to create individual wire sections. The wire processing system 10 can be configured to carry out a wide variety of functions, such as but not limited to cutting wire into desired section lengths, stripping off a section of wire insulation and crimping end connectors onto the wire sections. The operation of the wire processing system 10 is well known to one of ordinary skill in the art and the specific details of its operation will not be described in detail herein.

The wire processing system 10 includes a wire feed station 12 that draws wire from a continuous supply of wire on a spool, barrel or pre-feeder (not shown) and directs the wire to a cutting, stripping and crimping station 14. The operation of the wire feed station 12 and cutting station 14 are directed by a control unit 16 that includes a display 18. In the embodiment shown in FIG. 1, the wire processing system 10 includes a conveyor 20 for directing the wire sections 22 for further handling. The present disclosure generally relates to the configuration and design of the wire feed station 12, which is shown in greater detail in FIG. 3.

Figure 3:
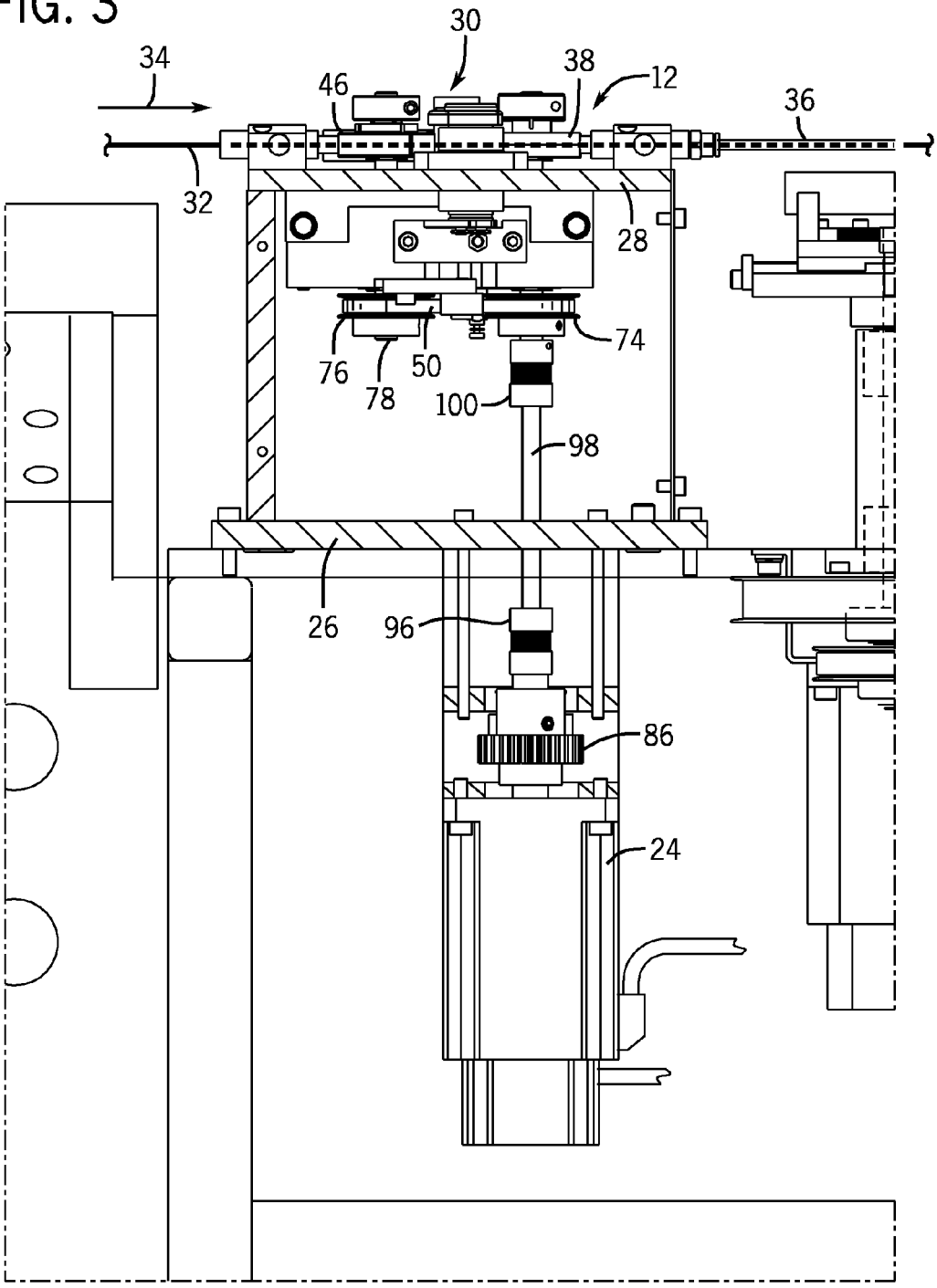
FIG. 3 is a magnified side view of the wire feed station illustrated by line 3-3 of FIG. 1.

As illustrated in FIG. 3, the wire feed station 12 includes a single drive motor 24 mounted to a motor support platform 26. The motor support platform 26, in turn, supports a feed platform 28 including an feed mechanism 30 that draws the supply of wire 32 in the direction shown by arrow 34. Wire 32 travels through the feed mechanism 30 and passes through a wire guide 36 where the wire 32 is directed to the downstream processing system of the wire processing system.

Figure 4:
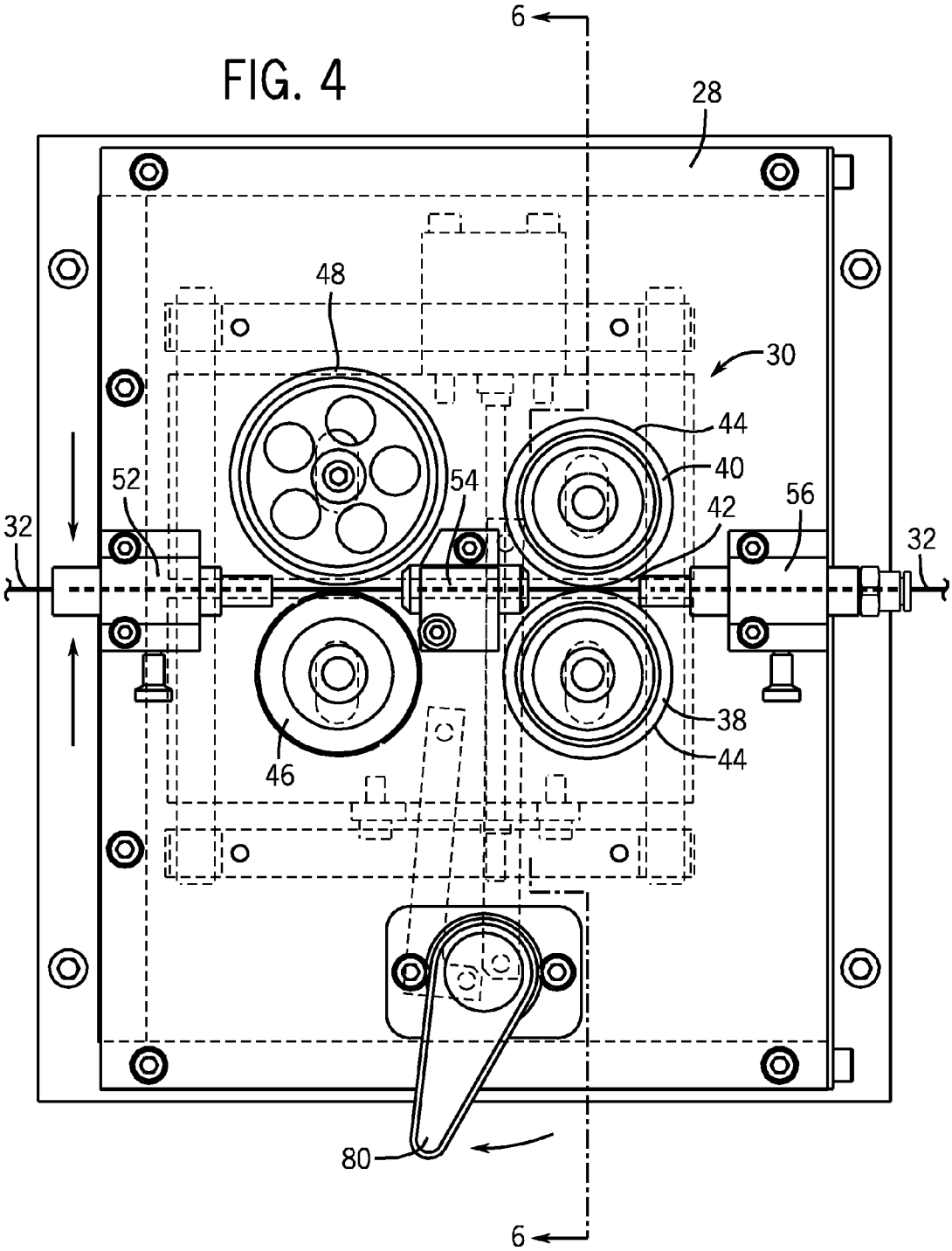
FIG. 4 is a top view of the wire feed station.

Referring now to FIG. 4, the feed mechanism 30 is shown in more specific detail. The feed mechanism 30 includes a first feed wheel 38 and a second feed wheel 40 that are positioned adjacent to each other to create a feed nip 42. The term "feed nip" will be used throughout the following disclosure to refer to the space between the first and second feed wheels 38, 40. The feed wheels 38, 40 are spaced such that the counter rotation of the feed wheels 38, 40 causes the feed wheels 38, 40 to engage the outer surface of the wire 32 to pull the wire through the feed nip 42 created by the feed wheels 38, 40.

The first and second feed wheels 38, 40 contact the wire 32 at the feed nip to pull the wire from the supply source. In the embodiment shown in FIG. 4, the first and second feed wheels 38, 40 include a resilient outer surface 44 that engages the wire to pull the wire from the supply source. The control unit actuates an air cylinder to open and/or close the first and second feed wheels 38, 40. The feed wheels 38, 40 move together and contact the external surface of the wire being processed.

The feed mechanism 30 further includes a third feed wheel 46 and an encoder wheel 48 positioned adjacent to each other. In the embodiment illustrated, the encoder wheel 48 and third feed wheel 46 are upstream from the first and second feed wheels 38, 40. However, the encoder wheel 48 and feed wheel 46 could be located downstream from the first and second feed wheels 38, 40. The third feed wheel 46 is coupled to the first feed wheel 38 by a belt 50 shown in FIG. 3 such that the first and third feed wheels 38, 46 rotate at the same speed. The encoder wheel 48 is freely rotatable and provides feedback to the control unit.

Referring back to FIG. 4, the feed mechanism 30 includes a first wire guide 52, a second wire guide 54 and a third wire guide 56 that direct the supply of wire through the feed mechanism 30. The wire guides 52, 54 and 56 are configured to accept wire 32 having different sizes such that the feed mechanism 30 can be utilized to process various wire gauges.

Figure 2:
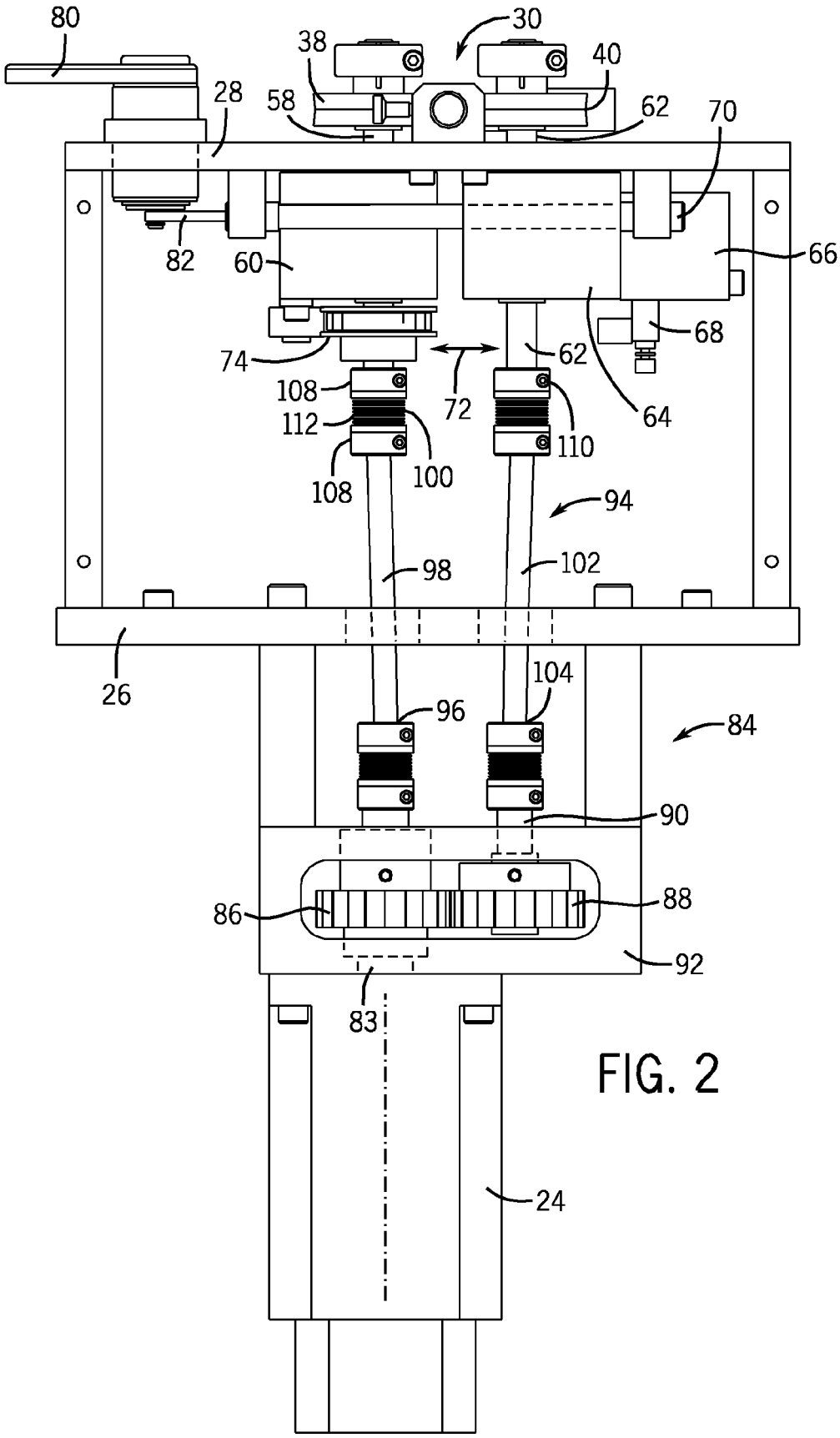
FIG. 2 is an end view of the wire feed station.

Referring now to FIG. 2, the first feed wheel 38 is mounted to a wheel shaft 58 that passes through a mounting block 60. Likewise, the second feed wheel 40 is mounted to a second wheel shaft 62 that passes through the mounting block 64. Both the first wheel shaft 58 and the second wheel shaft 62 extend entirely through the respective mounting blocks 60, 64 and each extend along a generally vertical axis. The vertical axis of the wheel shafts 58, 62 are parallel to each other.

The mounting blocks 60, 64 are each linked to a drive cylinder 66 that receives a supply of pressurized air from an air inlet 68. When pressurized air is supplied to the drive cylinder 66, the drive cylinder operates through a link rod 70 to move the mounting blocks 60, 64 toward and away from each other, as illustrated by arrow 72. The movement of the mounting blocks 60, 64 increases or decreases the size of the feed nip 42 shown in FIG. 2. The movement of the mounting blocks 60, 64 allows the feed mechanism 30 to vary the size of the feed nip to accommodate wire of varying outer diameters.

As illustrated in FIG. 3, the first wheel shaft includes a drive pulley 74 that is linked to a corresponding driven pulley 76 through the belt 50. The drive pulley 76 is mounted to the wheel shaft 78 of the third feed wheel 46. Thus, the combination of the pair of drive pulleys 74, 76 through the belt 50 causes synchronized rotation of the third feed wheel 46 with the first feed wheel 38.

Figure 5:
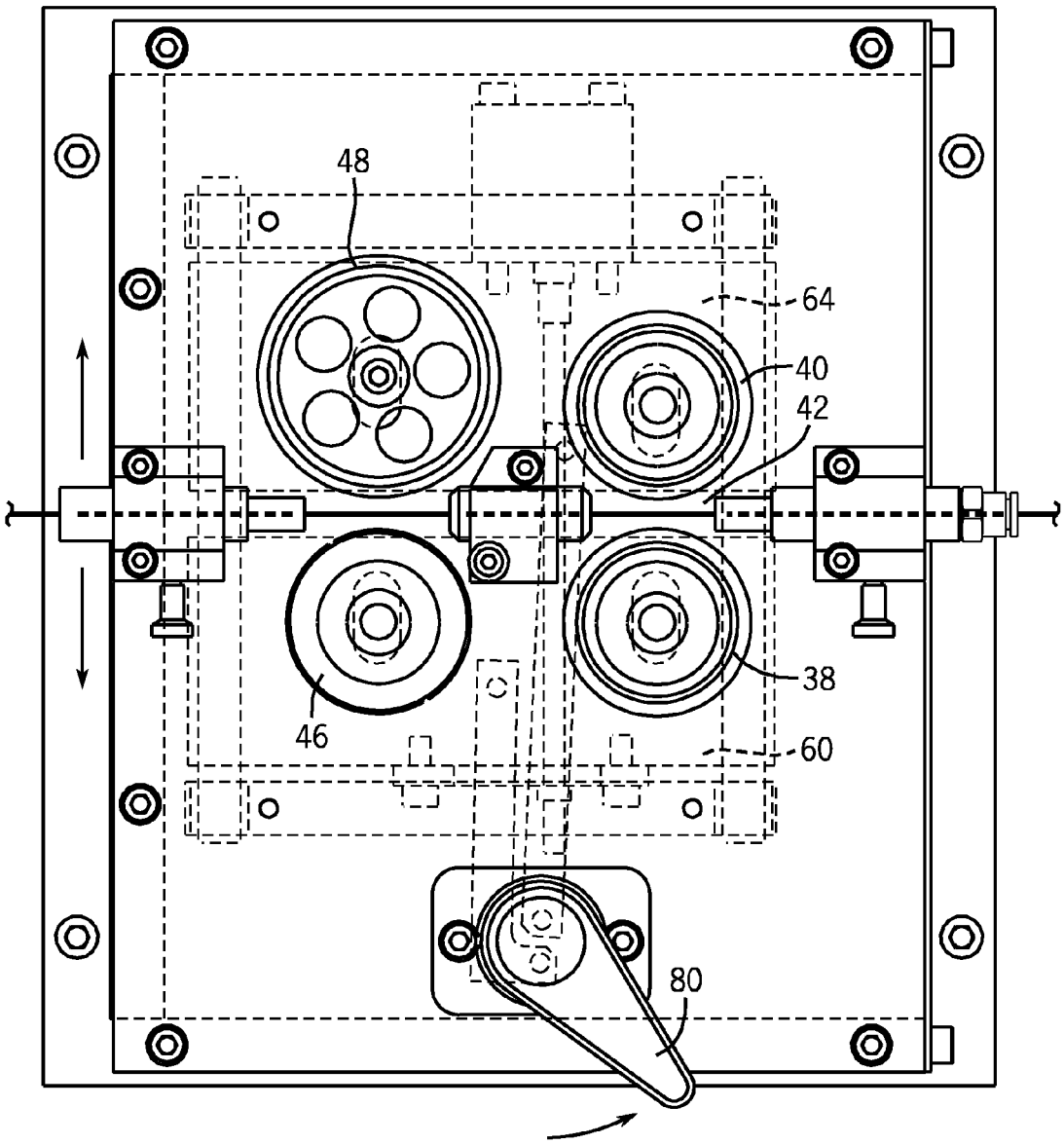
FIG. 5 is a top view similar to FIG. 4 illustrating the increase in the size of the feed nip.
Figure 6:
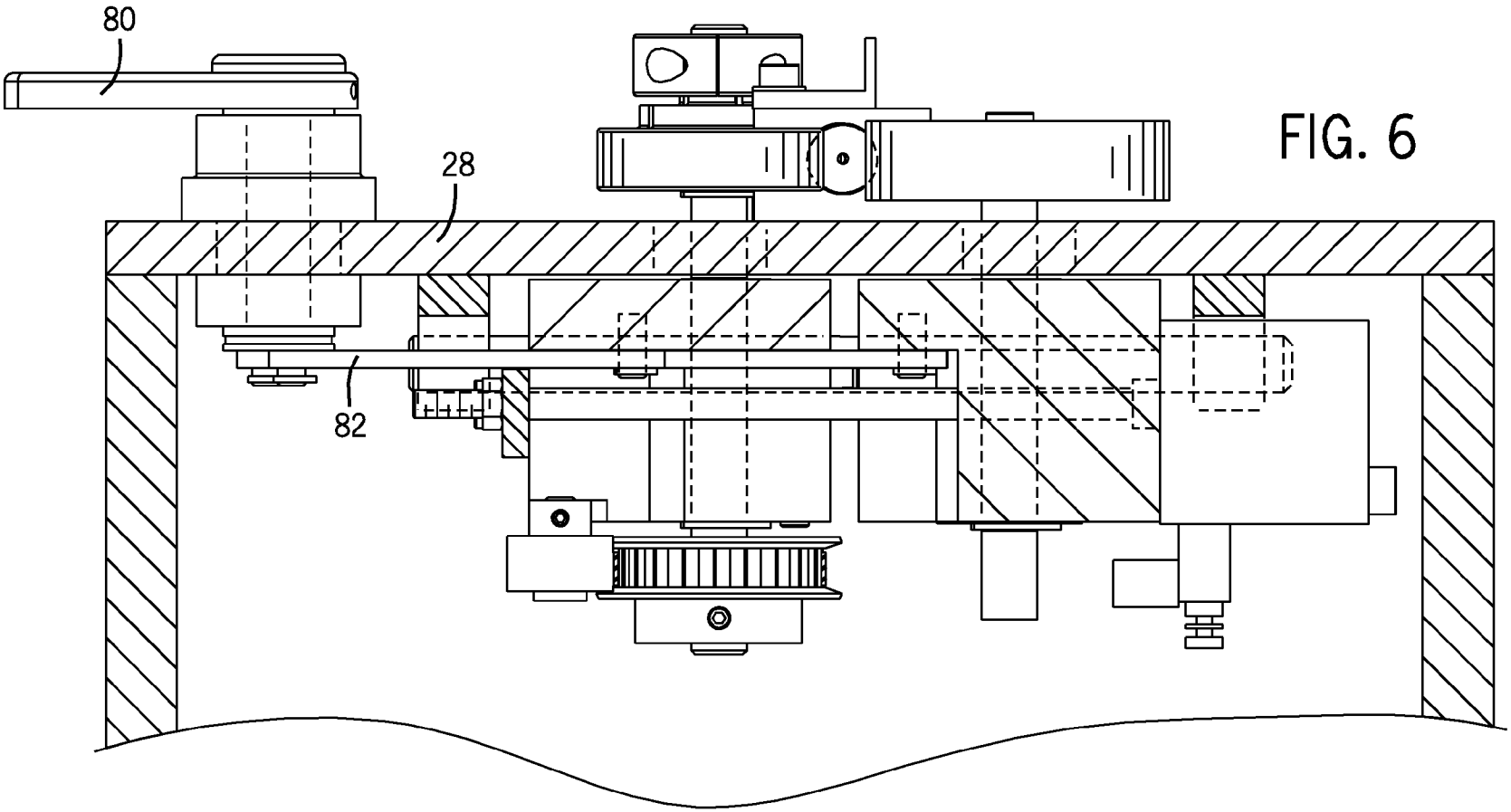
FIG. 6 is a partial section view illustrating the wire feed station.

Referring now to FIGS. 4 and 5, the feed mechanism 30 further includes a wire loading handle 80 that can be operated by a user to manually separate the first and second feed wheels 38, 40 for wire loading. In the position shown in FIG. 4, the loading handle 80 is in its engagement position during which the feed nip 42 is sized to engage the wire 32. When the loading handle 80 is moved to the loading position shown in FIG. 5, the first and second feed wheels 38, 40 move away from each other to greatly expand the feed nip 42. Since the encoder wheel 48 and the second feed wheel 40 are supported by the common mounting block 64 and the first feed wheel 38 and the third feed wheel 46 are each supported by the mounting block 60, the second feed wheel 40 and the encoder wheel 48 move together while the first feed wheel 38 and the third feed wheel 46 move together, as shown in FIG. 5.

As can be seen in FIG. 2, the loading handle 80 is coupled to the mounting blocks 60, 64 through a mechanical linkage 82 such that rotation of the loading handle 80 moves the mounting blocks 60, 64 relative to each other. The movement of the mounting blocks 60, 64 by the loading handle 80 is similar to the movement of the mounting block by the drive cylinder 66. As can be understood in FIG. 2, the mounting blocks 60, 64 are each supported below the generally planar feed platform 28 such that as the mounting blocks 60, 64 move relative to each other, the wheel shafts 58, 62 remain parallel to each other.

FIG. 2 illustrates the drive mechanism 84 used to operate the feed mechanism 30. The drive mechanism 84 includes the single drive motor 24. The drive motor 24 could be various types of available motors, such as a hydraulic motor, electric motor, or any similar type of motor capable of providing a rotating motive force. The single drive motor 24 includes a single motor shaft 83. In the embodiment shown in FIG. 2, the motor shaft 83 receives a first drive gear 86 that is securely mounted to the motor shaft for direct rotation therewith. The first drive gear 86 is positioned in direct engagement with a second drive gear 88. The second drive gear 88 is mounted to a driven shaft 90. As illustrated in FIG. 2, both the motor shaft 83 and the second drive shaft 90 are rotatably supported within a gear housing 92 to which the drive motor 24 is also mounted. The motor shaft 83 and the driven shaft 90 each extend along parallel rotational axes that, in the embodiment of FIG. 2, are vertical. Since the gear housing 92 is stationary and fixed to the platform 26, the axis of rotation for the motor shaft 83 and the driven shaft 90 are fixed. During rotation of the drive motor 24, the motor shaft 83 rotates the first drive gear 86, which in turn results in driven rotation of the second drive gear 88. Since the second drive gear 88 is fixed to the driven shaft 90, the drive motor directly rotates the motor shaft 83 and rotates the driven shaft 90 through the engagement of the first and second drive gears 86, 88.

As described previously, the position of the mounting blocks 60, 64 can be adjusted during operation of the wire feed mechanism 30. As the mounting blocks 60, 64 move relative to each other, the distance between the wheel shafts 58, 62 changes. Thus, a linkage mechanism 94 is required to translate the rotational movement of the motor shaft 83 and the driven shaft 90 to the wheel shaft 58 and the wheel shaft 62.

FIG. 2 illustrates the linkage mechanism 94 constructed in accordance with the present disclosure. The linkage mechanism 94 includes a first flexible coupling 96 positioned between the motor shaft 83 and a first end of a first drive shaft 98. A second flexible coupling 100 is positioned between a second end of the drive shaft 98 and the wheel shaft 58. The combination of the drive shaft 98 and the first and second flexible couplings 96, 100 translates the rotational movement of the motor shaft 83 to rotational movement of the wheel shaft 58.

The linkage mechanism 94 further includes a second drive shaft 102 having a first end coupled to the driven shaft 90 through a third flexible coupling 104. The second drive shaft 102 is rotatably coupled to the wheel shaft 62 through a fourth flexible coupling 106. In the position shown in FIG. 2, the drive shafts 98, 102 are positioned at a slight angle relative to each other to compensate for the difference in distances between the wheel shaft 58 and the wheel shaft 62 relative to the distance between the motor shaft 83 and the driven shaft 90. The flexible couplings 96, 100, 104 and 106 compensate for the movement of the mounting blocks 60, 62 to increase or decrease the size of the feed nip.

In the embodiment shown in FIG. 2, each of the flexible couplings 96, 100, 104 and 106 is a commercially available shaft coupler, such as available from Ruland Manufacturing. Each of the flexible couplings includes a pair of attachment collars 108 that are secured to a shaft through an attachment device 110. The attachment collars 108 are joined to each other through a flexible bellows that allows the attachment collars 108 to move relative to each other while maintaining the required strength and rigidity to translate the rotational movement across the flexible coupling.

Although the embodiment shown in FIG. 2 includes two flexible couplings mounted to each of the drive shafts 98, 102, it is contemplated that only a single flexible coupling could be utilized on each of the drive shafts 98, 102, depending upon the amount of movement required between the mounting blocks 60, 62. The use of the pair of flexible couplings on each of the drive shafts 98, 102 allows for increased relative movement between the mounting blocks 60, 62.

Although a specific type of flexible coupling is shown in the drawing Figures, it should be understood that different types of flexible couplings could be utilized while operating within the scope of the present disclosure. The flexible coupling must be able to allow relative movement between shafts on either end of the coupling while translating rotational movement from one shaft to another.

The driving and linkage assembly of the present disclosure can be utilized in many different applications other than to draw wire through a feed mechanism. As an illustrative example, the driving and linkage assembly could be used at any location where it is desired to move a section of wire from one location to another. The use of the single drive motor and the linkage to a pair of driven fee wheels could be modified to many other applications.

Additionally, although disclosure illustrates the use of a pair of spaced feed wheels that engage the outer surface of a section of wire, many alternate configurations are contemplated. As an example, each of the feed wheels could be coupled to another wheel through a belting or gear arrangement to pull wire through the system. The belting could be used to engage the wire section to increase the friction force between the feed wheels and the wire. In such alternate embodiments, at least two of the feed wheels would be coupled to the single drive motor through the coupling system of the present disclosure.

We claim:

1. A drive assembly for a wire feeding station having a first feed wheel and a second feed wheel that form an adjustable feed nip to pull a wire through the wire feeding station, comprising:

a single drive motor having a motor shaft extending along a drive axis;

a first drive gear fixed to the motor shaft of the drive motor;

a second drive gear positioned in engagement with the first drive gear such that rotation of the first drive gear rotates the second drive gear;

a rigid first drive shaft operable to rotate the first feed wheel and having a first end coupled to the first drive gear by a first flexible coupling and a second end coupled to the first feed wheel by a second flexible coupling; and a rigid second drive shaft operable to rotate the second feed wheel and having a first end coupled to the second drive gear through a third flexible coupling and a second end rotatably coupled to the second feed wheel through a fourth flexible coupling, wherein the first feed wheel and the second feed wheel are each supported by a mounting block, wherein the mounting blocks are movable relative to each other to adjust the position of both the first feed wheel and the second feed wheel of the feed nip, wherein the flexible couplings provide a driven link between the drive motor and the first and second feed wheels and allow the first and second drive shafts to be separately angled relative to the drive axis as the first and second feed wheels move relative to each other.

2. The drive assembly of claim 1 wherein both the first feed wheel and the second feed wheel include a wheel shaft, wherein the wheel shaft of the first feed wheel is coupled to the second flexible coupling and the wheel shaft of the second feed wheel is coupled to the fourth flexible coupling.

3. The drive assembly of claim 2 wherein the wheel shaft of the first feed wheel and the wheel shaft of the second feed wheel each extend parallel to the drive axis.

4. The drive assembly of claim 3 wherein the wheel shaft of the first feed wheel includes a pulley coupled to a third feed wheel through a belt such that the pulley and belt rotate the third feed wheel.

5. The drive assembly of claim 4 further comprising an encoder wheel operatively positioned in contact with the third feed wheel.

6. A wire feed station, comprising:

a first feed wheel supported by a first mounting block;

a second feed wheel supported by a second mounting block, wherein the first feed wheel and the second feed wheel create a feed nip, wherein the first mounting block and the second mounting block are movable relative to each other to adjust the position of both the first and second feed wheels and the size of the feed nip;

a single drive motor having a motor shaft extending along a drive axis;

a first drive gear mounted to the motor shaft;

a second drive gear positioned in engagement with the first drive gear such that rotation of the first drive gear rotates the second drive gear;

a rigid first drive shaft operable to rotate the first feed wheel and having a first end coupled to the first drive gear through a first flexible coupling and a second end coupled to the first feed wheel through a second flexible coupling;

a rigid second drive shaft operable to rotate the second feed wheel and having a first end coupled to the second drive gear through a third flexible coupling and a second end rotatably coupled to the second feed wheel through a fourth flexible coupling;

wherein the flexible couplings allow the first and second drive shaft to be angled relative to the drive axis as the position of both the first feed wheel and the second feed wheel of the feed nip is adjusted while providing a driven connection between the single drive motor and the first and second feed wheels.

7. The wire feed station of claim 6 wherein both the first feed wheel and the second feed wheel include a wheel shaft, wherein the wheel shaft of the first feed wheel extends through the first mounting block and the wheel shaft of the second feed wheel extends through the second mounting block.

8. The wire feed station of claim 7 wherein the first wheel shaft and the second wheel shaft are parallel to a drive axis defined by the motor shaft.

9. The wire feed station of claim 6 wherein the flexible couplings are bellows couplings.

10. The wire feed station of claim 8 wherein the wheel shaft of the first feed wheel includes a pulley coupled to a third feed wheel through a belt such that the pulley and belt rotate the third feed wheel.

11. The wire feed station of claim 6 further comprising a loading handle coupled to both the first mounting block and the second mounting block such that the loading handle can be actuated to move the first and second mounting blocks relative to each other.

* * * * *